US007204763B2

(12) United States Patent
Beynon

(10) Patent No.: US 7,204,763 B2
(45) Date of Patent: Apr. 17, 2007

(54) ICE SKATING ARENA

(76) Inventor: Murray Beynon, 109 Dawlish Avenue, Toronto (CA) M4N 1H4

( * ) Notice: Subject to any disclaimer, the term of this patent is extended or adjusted under 35 U.S.C. 154(b) by 645 days.

(21) Appl. No.: 10/260,600

(22) Filed: Sep. 30, 2002

(65) Prior Publication Data

US 2003/0061769 A1 Apr. 3, 2003

(30) Foreign Application Priority Data

Oct. 3, 2001 (CA) ..... 2358198

(51) Int. Cl.
*A63C 1/00* (2006.01)

(52) U.S. Cl. ..... 472/92; 52/6; 472/90

(58) Field of Classification Search ..... 62/235, 62/259.1; 52/6–10, 79.1–79.14, 36.1–40, 52/235, 259; 472/90–92
See application file for complete search history.

(56) References Cited

U.S. PATENT DOCUMENTS 4,038,834 A * 8/1977 Roberts ..... 62/235
4,164,018 A * 8/1979 Legrand ..... 52/8
4,202,543 A * 5/1980 Collins ..... 272/3
4,497,483 A * 2/1985 Ahlgren ..... 272/3
6,126,551 A * 10/2000 Martin ..... 472/92

* cited by examiner

*Primary Examiner*—Jeanette Chapman
(74) *Attorney, Agent, or Firm*—Hodgson Russ LLP

(57) ABSTRACT

An ice skating arena having at least a first ice rink having a first side wall of a first wall length and a second ice rink having a second side wall of a second wall length; the first side wall being parallel to the second side wall at an inter-rink distance therefrom; the first side wall comprising a first protective spectator viewing window; the second side wall comprising a second protective spectator viewing window, a ceiling extending the inter-rink distance from the first wall and the second wall along at least a portion of the first and second walls; a floor extending the inter-rink distance from the first wall and the second wall along at least a portion of the first and second walls; wherein the first side wall, the second side wall, the ceiling and the floor define therebetween a chamber comprising a climate controlled spectator viewing space. The area provides enhanced spectator comfort in a maximum unencumbered viewing manner and reduced capital cost expenditures.

9 Claims, 3 Drawing Sheets

ICE SKATING ARENA

This application claims priority of Canadian application no. 2,358,198 filed on Oct. 3, 2001, the disclosure of which is incorporated herein by reference.

FIELD OF THE INVENTION

This invention relates to ice skating arenas having a plurality of adjacent ice rinks, preferably enclosed within a building.

BACKGROUND OF THE INVENTION

Ice skating rinks are, generally, of an obround, i.e. rounded, rectangular shape having a pair of parallel sides of a longer length than each of the opposing ends of the rink. Buildings constituting ice skating arenas having at least two ice skating rinks of aforesaid structure adjacent one to another are known wherein a longer side of a rink is parallel to the longer side of an adjacent rink at an inter-rink distance therefrom. The area defined by the inter-rink distance between the rink ends, typically, provides part of the spectators' sitting or standing viewing area, wherein each of the rink sides are most often provided with protective glass panes upwardly standing from the side boards, particularly, if ice hockey activities are played. Unfortunately, the spectators within this inter-rink area, while being closer to the ice playing surface, are subject to the cold temperature of the ice rink environment.

In an alternative structure, while the protective glass-side boards are present, a climate controlled area is provided for spectators formed by a pair of spaced apart vertically aligned walls extending to the roof, wherein each wall has a viewing window and is set back from the rink sides. Thus, although the spectators are in a more comfortable environment, they are located further away from the ice rink activities with attendant resultant poorer viewing opportunity and reduced spectator/player "interaction". Further, by having these two significantly-spaced double glass walls within the inter-rink space between the rinks, a high proportion of this space is wasted in not providing the maximum spectator comfort zone. Yet further, extra capital building cost is incurred in having the "four-glass partition" inter-rink structure.

There is, therefore, a need for a structure which provides maximum unencumbered spectator viewing area in a comfortable environment in a more efficacious and cost-effective manner.

SUMMARY OF THE INVENTION

It is an object of the present invention to provide an ice skating arena having a plurality of ice rinks which provide enhanced spectator comfort in an improved unencumbered viewing manner and capital cost expenditures.

Accordingly, the invention provides in one aspect an ice skating arena having at least a first ice rink having a first side wall of a first wall length and a second ice rink having a second side wall of a second wall length; said first side wall being parallel to said second side wall at an inter-rink distance therefrom; said first side wall comprising a first protective spectator viewing window; said second side wall comprising a second protective spectator viewing window, a ceiling extending said inter-rink distance from said first wall and said second wall along at least a portion of said first and second walls; a floor extending said inter-rink distance from said first wall and said second wall along at least a portion of said first and second walls; wherein said first side wall, said second side wall, said ceiling and said floor define therebetween a chamber comprising a climate controlled spectator viewing space.

Preferably, each of the rinks are obround wherein the ice surface is surrounded and contained within upstanding side boards which define the obround shape.

Further, the ice rinks are, optionally, enclosed in a building wherein the ice rinks per se are also sheltered from the weather elements of snow, rain, sunshine and the like. Although the invention is of value when only two adjacent rinks are present, it can be seen that a plurality of such adjacent rinks, i.e. in this specification and claims meaning more than two rinks, can benefit from the principle of the invention.

The ceiling may extend to any length along the side walls as desired. Indeed, it may extend beyond the side walls and comprise part of the climate controlled chamber extending around the end side boards of the rinks, if desired.

Any suitable ceiling structure and its appropriate supporting means may be chosen. It may be of a suspended structure, and be vertically adjustable with suitable raising and lowering means.

The chamber, in whole or in part, may be climate controlled by any suitable means, such as baseboard or other electrical means, forced air, water radiator heaters or the like.

Thus, the arena according to the invention as hereinabove defined enables the fans to be closer to the action and in a warm and safe environment in a radically novel manner which uses the rink boards and glass as the wall component and a suspended ceiling at the top of the glass for the thermal, safety and acoustical separation between the spectator zone and the actual area of the ice rinks. Compared to prior art designs, this eliminates the need for a second glass wall partition for each rink and/or approximately 2,000–3,000 s.f. (200–300 $m^2$) of space that is no longer required.

BRIEF DESCRIPTION OF THE DRAWINGS

In order that the invention may be better understood, preferred embodiments will now be described, by way of example only, with reference to the accompanying drawings, wherein.

DETAILED DESCRIPTION OF PREFERRED EMBODIMENTS

Generally, the walls comprise ice rink dasher-board arrangement having tempered glass or plexiglass vision panels, perimeter expansion joint, thermal isolation material and custom interior finish panel. The canopy is formed of structural steel or lightweight steel framing suspended from the main building structure, with pre-finished metal decking and ½" polyethylene panel fascia. An alternate canopy design incorporates a lightweight tensile fabric structure suspended from the main building structure.

The canopy is isolated from the top of the glass panels, typically, a 1" (2.54 cm) joint with a flexible closure strip.

Figure 1:
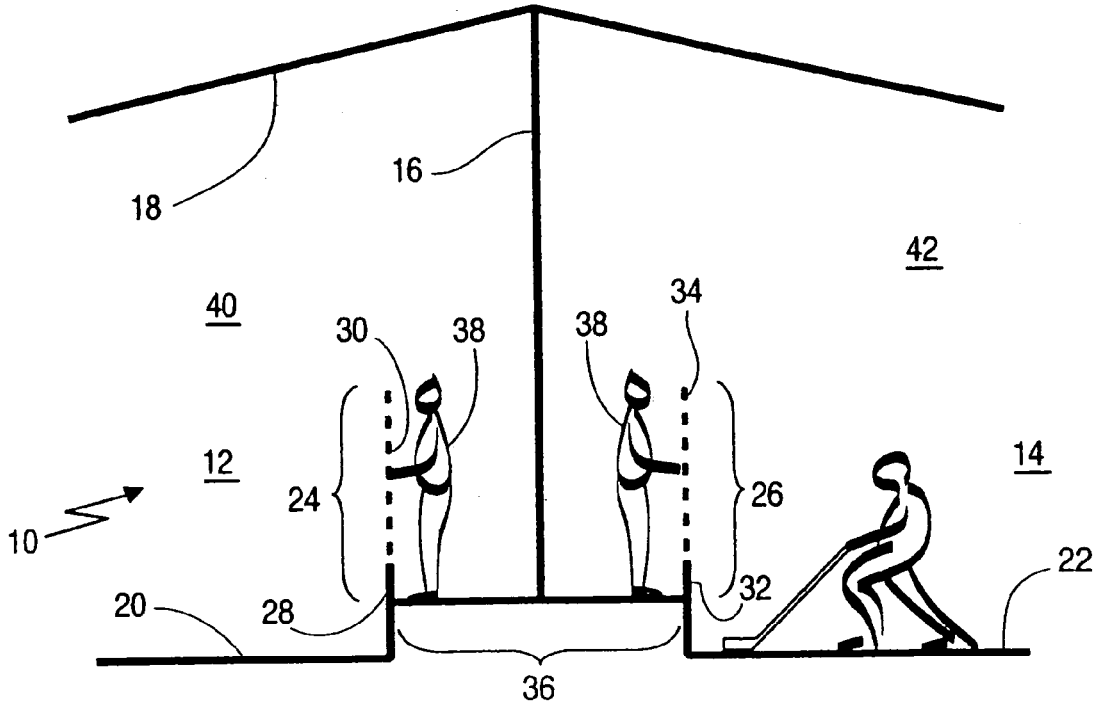
Figure 1 (Prior Art)
FIG. 1 is a diagrammatic outline of a cross-section of a pair of adjacent ice rinks (in part) in an arena according to the prior art.

With reference to FIG. 1 this shows, in part, generally as 10 an ice-skating arena having a pair of ice rinks 12 and 14 separated by a supporting wall 16 under a common roof 18. Rinks 12 and 14 have a playing surface 20 and 22, respectively, and side walls 24, 26, respectively, comprising dasher boards 28 and protective glass panels 30, and, dasher boards 32 and protective glass panels 34, respectively.

Side walls 24 and 26 are separated by an inter-rink distance 36 and supporting wall 16. The inter-rink space between side walls 24 and 26 running the length of the respective side walls, 24 and 26 constitute in whole or, in part, the spectator viewing area occupied by spectators 38. It can be seen that the spectator temperature environment is either at or approximate that of the rink playing space 40, 42.

Figure 2:
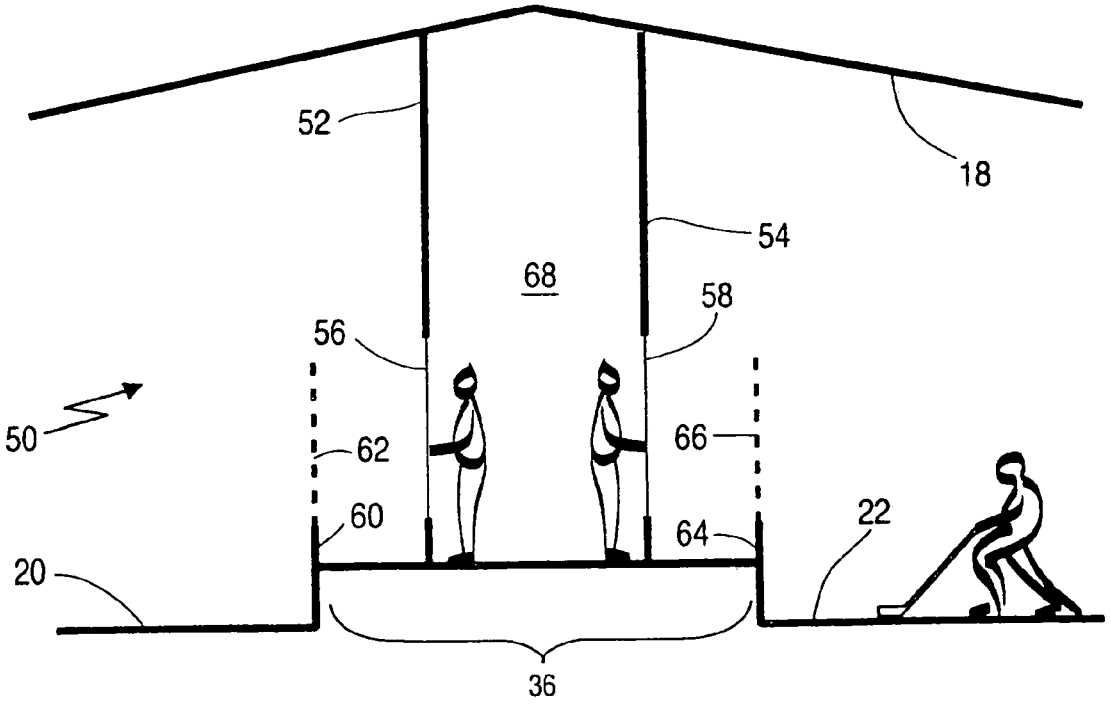
Figure 2 (Prior Art)
FIG. 2 is a diagrammatic outline of a cross-section of a pair of adjacent ice rinks (in part) in an alternative arena embodiment according to the prior art.

With reference to FIG. 2, this shows an arena, generally, as 50, having a pair of spaced apart supporting walls 52, 54, each having its own spectator viewing window 56, 58, respectively, and, respectively, located a distance from dasher boards 60, and glass panels 62; and dasher boards 64 and glass panels 66.

Walls 52 and 54 extend upwardly to roof 18 to provide a climate controlled spectator space 68.

Figure 3:
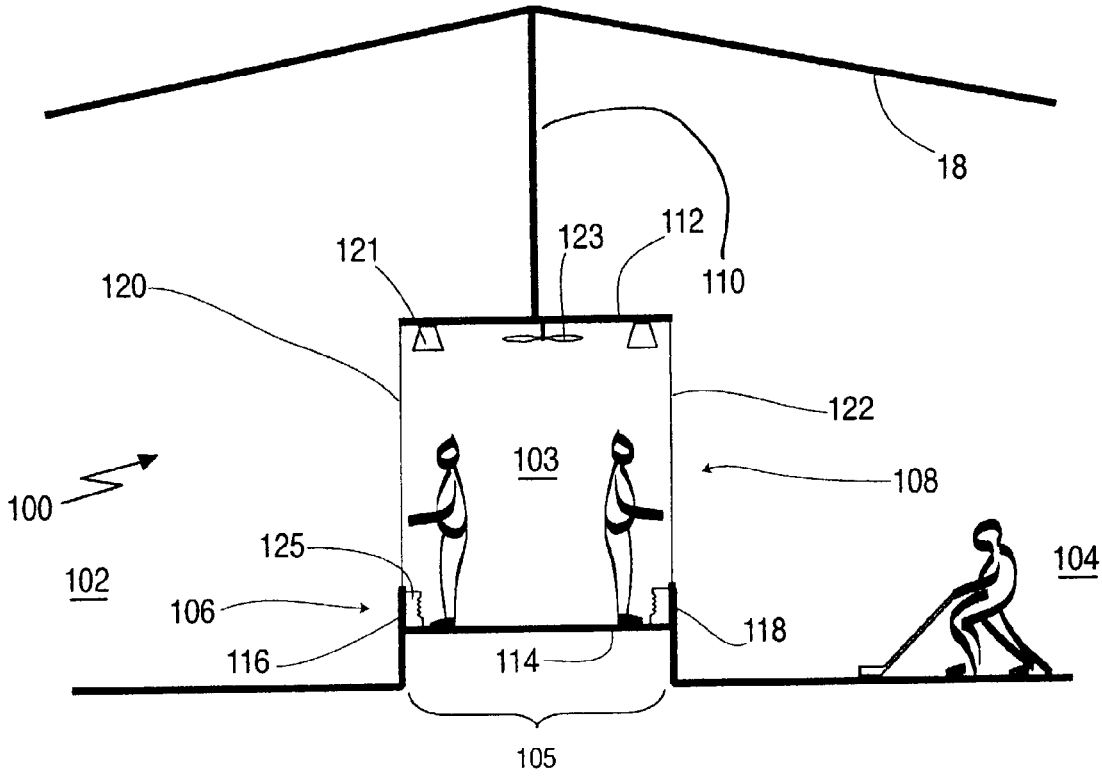
FIG. 3 is a diagrammatic outline of a cross-section of a pair of adjacent ice rinks (in part) according to the invention.

With reference to FIG. 3, this shows generally as 100, an arena having rinks 102 and 104 and a spectator viewing space 103, having (i) a width of inter-rink distance 105 extending from side wall 106 of rink 102 to side wall 108 of rink 104, (ii) a length of side walls 106, 108 and (iii) a height part way of the height to roof 18. Roof 18 is supported by column 110, which also passes through a suspended ceiling 112, which ceiling, with side walls 106, 108 and inter-rink floor 114, defines climate controlled spectator viewing space 103. Each of side walls 106, 108 comprise dasher boards 116, 118, respectively, and protective glass windows 120, 122, respectively. Chamber 103 is provided with hot air ducts 121, circulating fan 123 and baseboard heaters 125.

Thus, in the embodiment described under FIG. 3, the protective glass 120, 122 constitutes not only part of the support of ceiling 112 but provides spectator viewing windows at the rinks edges for maximum unencumbered viewing and provide maximum utilization of spectator space under the climate controlled conditions with the elimination of a pair of protective glass panes seen in the prior art, which reduces capital structural costs and obviates a spectator from having to look through two glass windows to view the ice playing area.

Figure 4:
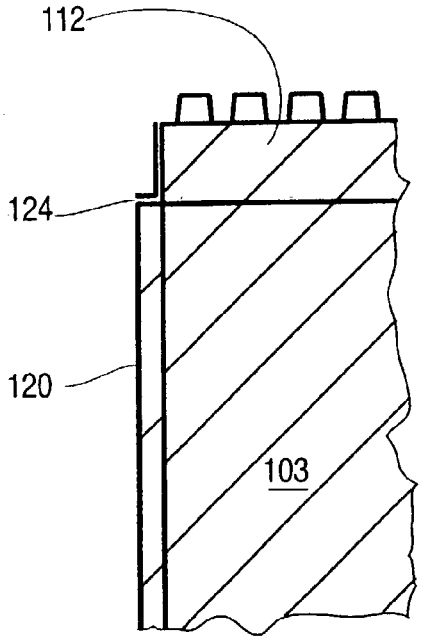
FIG. 4 is a diagrammatic outline of a cross-section of a pair of adjacent ice rinks (in part) according to the invention.

Ceiling 112 may be either flat or sloped and located at any desired height from floor 114. In alternative embodiments, with reference to FIG. 4 which shows, in brief, detail of a ceiling and side wall structure allowing for the height of ceiling 112 to be adjusted and so supported by flexible side members 124 to provide for the raising or lowering differential movement of glass panes 120, 122 relative to the ceiling structure. It will be readily understood, that the dimensions of spectator viewing space 103 can be readily selected based on desired inter-rink width, height and length and the structure constructed with known materials by known engineering methods.

The space 103 may further comprise spectator amenities such as seats, eating and drinking facilities, such as, for example, cafes, play areas, meeting rooms, suites, administrative offices and the like.

Figure 5:
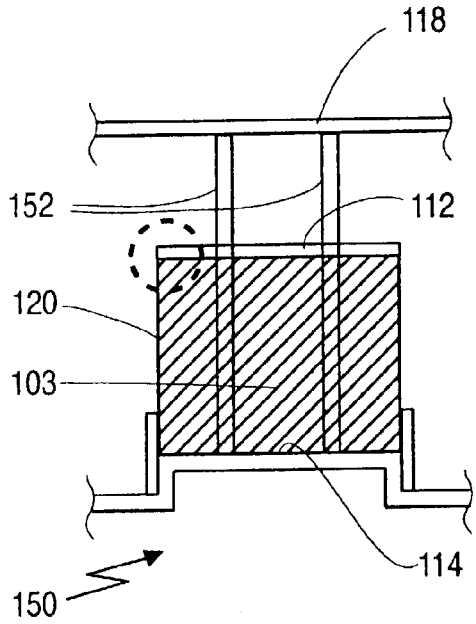
FIG. 5 is a diagrammatic cross-sectional view of an alternative spectator viewing chamber in an arena according to the invention.
Figure 6:
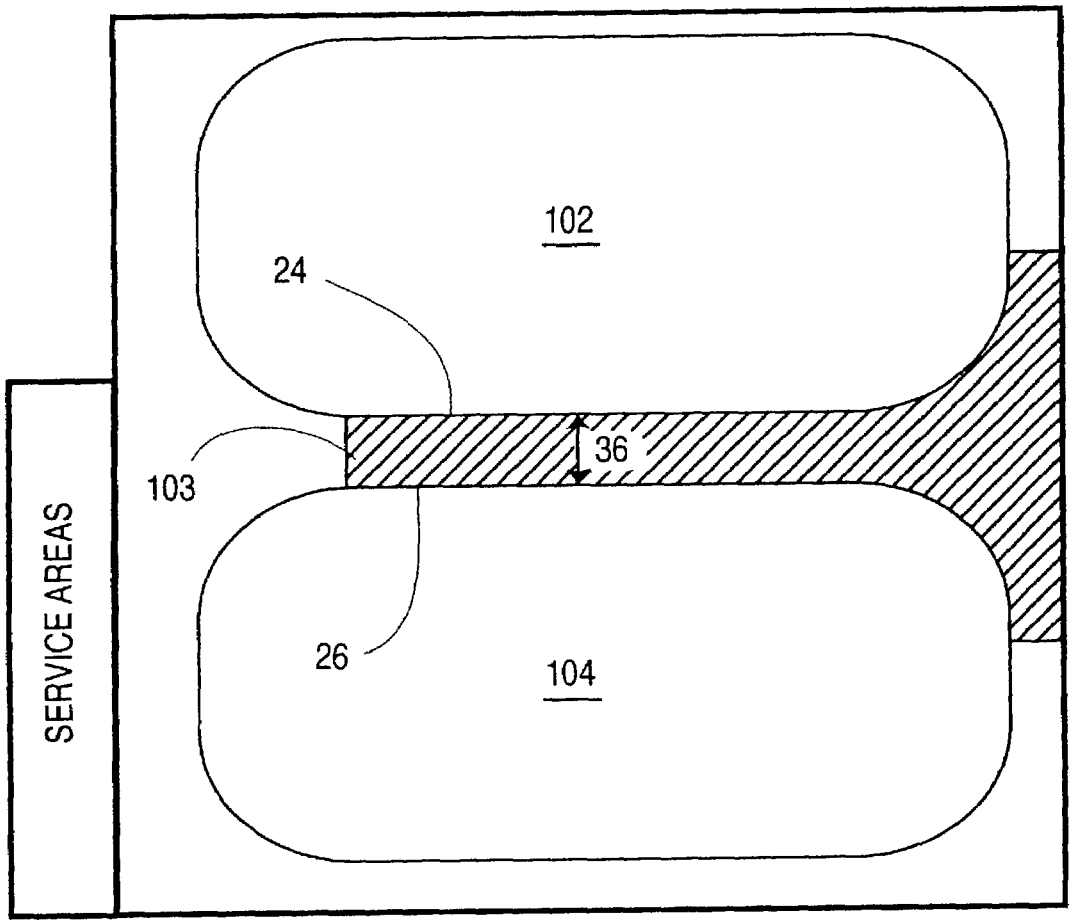
FIG. 6 is a schematic plan view of a pair of obround adjacent ice rinks; and wherein the same numerals denote like parts.

With reference to FIG. 5, this shows, generally as 150, a climate controlled viewing chamber of an arena according to the invention having a pair of supporting columns 152 extending to roof 118.

Although this disclosure has described and illustrated certain preferred embodiments of the invention, it is to be understood that the invention is not restricted to those particular embodiments. Rather, the invention includes all embodiments which are functional or mechanical equivalents of the specific embodiments and features that have been described and illustrated.

The invention claimed is:

1. An ice skating arena having at least a first ice rink having a first side wall of a first wall length and a second ice rink having a second side wall of a second wall length; said first side wall being parallel to said second side wall at an inter-rink distance therefrom; said first side wall comprising a first protective spectator viewing window; said second side wall comprising a second protective spectator viewing window, a ceiling extending said inter-rink distance from said first wall and said second wall along at least a portion of said first and second walls;

a floor extending said inter-rink distance from said first wall and said second wall along at least a portion of said first and second walls;

wherein said first side wall, said second side wall, said ceiling and said floor define therebetween a chamber comprising a climate controlled spectator viewing space.

2. An arena as defined in claim 1 wherein said first side wall further comprises first hockey boards; and said second side wall further comprises second hockey boards.

3. An arena as defined in claim 1 wherein each of said first and said second rinks is of an obround, rectangular structure.

4. An arena as defined in claim 1 further comprising a plurality of said ice rinks.

5. An arena as defined in claim 1 further comprising a building having a roof, walls and floor enclosing said ice rinks.

6. An arena as defined in claim 1 wherein said ceiling is suspended.

7. An arena as defined in claim 1 wherein said ceiling is upwardly moveable relative to said first and second protective spectator viewing windows.

8. An arena as defined in claim 1 wherein said chamber has heating means selected from the group consisting of forced air ducts, electrical heaters and hot water radiators to effect said climate control.

9. An arena as defined in claim 1 wherein said chamber extends the length of each of said first wall length and said second wall length.

* * * * *